US011485136B2

(12) United States Patent
Ishizuka et al.

(10) Patent No.: US 11,485,136 B2
(45) Date of Patent: Nov. 1, 2022

(54) LIQUID DISCHARGE HEAD AND METHOD FOR MANUFACTURING LIQUID DISCHARGE HEAD

(71) Applicant: CANON KABUSHIKI KAISHA, Tokyo (JP)

(72) Inventors: Kazunari Ishizuka, Shizuoka (JP); Satoshi Tsutsui, Kanagawa (JP); Yohei Hamade, Tokyo (JP); Isamu Horiuchi, Kanagawa (JP); Miho Ishii, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 47 days.

(21) Appl. No.: 17/153,081

(22) Filed: Jan. 20, 2021

(65) Prior Publication Data

US 2021/0229437 A1 Jul. 29, 2021

(30) Foreign Application Priority Data

Jan. 27, 2020 (JP) ..... JP2020-010956

(51) Int. Cl.
*B41J 2/14* (2006.01)
*B41J 2/16* (2006.01)

(52) U.S. Cl.
CPC ..... *B41J 2/14* (2013.01); *B41J 2/1626* (2013.01); *B41J 2/1631* (2013.01); *B41J 2/1645* (2013.01)

(58) Field of Classification Search
CPC . B41J 2/14; B41J 2/1626; B41J 2/1631; B41J 2/1645; B41J 2/1603; B41J 2/1606; B41J 2/1639
See application file for complete search history.

(56) References Cited

U.S. PATENT DOCUMENTS 5,478,606 A 12/1995 Ohkuma et al.
2018/0244043 A1* 8/2018 Tsutsui ..... B41J 2/1646

FOREIGN PATENT DOCUMENTS

JP 6-286149 A 10/1994

OTHER PUBLICATIONS

IP.com search (Year: 2022).*
Horiuchi et al., U.S. Appl. No. 17/149,979, filed Jan. 15, 2021.
Tsutsui et al., U.S. Appl. No. 17/128,445, filed Dec. 21, 2020.

* cited by examiner

*Primary Examiner* — Lisa Solomon
(74) *Attorney, Agent, or Firm* — Venable LLP

(57) ABSTRACT

A liquid discharge head including: a substrate having a liquid supply port; a flow channel forming member that is provided on the substrate and has discharge ports for discharging a liquid and a liquid flow channel that makes the liquid supply port and the discharge ports communicate with each other; and a support member that is provided on the substrate and arranged to be in contact with at least one surface of the flow channel forming member, with the one surface not being in contact with the liquid, wherein the flow channel forming member includes a cured product of a first photosensitive resin composition including a photosensitive resin, the support member includes a cured product of a second photosensitive resin composition including the epoxy resin A having a structure represented by formula (a1) or (a2) below in main chain structure:

(a1)

$$-O-(CH_2)_{n_1}-$$

(a2)

$$-O-(CH_2)_{n_2}-\overset{\overset{O}{\|}}{C}-$$

where, $n_1$ and $n_2$ represent integers of at least 2.

13 Claims, 2 Drawing Sheets

LIQUID DISCHARGE HEAD AND METHOD FOR MANUFACTURING LIQUID DISCHARGE HEAD

BACKGROUND OF THE INVENTION

Field of the Invention

The present disclosure relates to a liquid discharge head and a method for manufacturing a liquid discharge head.

Description of the Related Art

Use of a liquid discharge head that discharges a liquid is exemplified in an inkjet recording system in which ink is discharged to a recording medium for recording.

An inkjet head suitable for the inkjet recording system (liquid jet recording method) generally includes a plurality of fine discharge ports, liquid (ink) flow channels, and energy generating elements for generating energy to be used for discharging a liquid, which are provided in parts of flow channels of the liquid.

A conventional method for manufacturing such an inkjet head is described in, for example, Japanese Patent Application Publication No. H06-286149. First, a pattern of an ink flow channel is formed using a soluble resin on a substrate on which energy generating elements have been formed. Next, a coating resin layer including an epoxy resin serving as an ink flow channel and a photocationic polymerization initiator is formed on the ink flow channel pattern, and discharge ports are formed above the energy generating elements by photolithography. Finally, the soluble resin is eluted and the coating resin layer serving as the ink flow channel is cured to form an ink flow channel forming member.

SUMMARY OF THE INVENTION

The present disclosure is a liquid discharge head comprising:

a substrate having a liquid supply port;

a flow channel forming member that is provided on the substrate and has discharge ports for discharging a liquid and a liquid flow channel that makes the liquid supply port and the discharge ports communicate with each other; and a support member that is provided on the substrate and arranged to be in contact with at least one surface of the flow channel forming member, with the one surface not being in contact with the liquid, wherein the flow channel forming member includes a cured product of a first photosensitive resin composition, the support member includes a cured product of a second photosensitive resin composition, the first photosensitive resin composition includes a photosensitive resin, and the second photosensitive resin composition includes the epoxy resin A having an epoxy group at an end of a molecular chain and having a structure represented by formula (a1) or (a2) below in a main chain structure.

Further, the present disclosure a method for manufacturing a liquid discharge head including:

a substrate having a liquid supply port;

a flow channel forming member that is provided on the substrate and has discharge ports for discharging a liquid and a liquid flow channel that makes the liquid supply port and the discharge ports communicate with each other; and a support member that is provided on the substrate and arranged to be in contact with at least one surface of the flow channel forming member, with the one surface not being in contact with the liquid, the method comprising:

patterning a first photosensitive resin composition on the substrate to form a flow channel forming member having discharge ports that discharge the liquid and a liquid flow channel that makes the liquid supply port and the discharge ports communicate with each other; and patterning a second photosensitive resin composition to form a support member to be in contact with at least one surface of the flow channel forming member on the substrate, with the one surface not being in contact with the liquid, wherein the first photosensitive resin composition includes a photosensitive resin, and the second photosensitive resin composition includes the epoxy resin A having an epoxy group at an end of a molecular chain and having a structure represented by formula (a1) or (a2) below in a main chain structure.

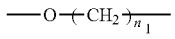

(a1)

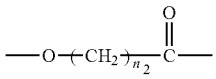

(a2)

(In (a1), $n_1$ represents an integer of at least 2, and in (a2), $n_2$ represents an integer of at least 2.)

Further features of the present invention will become apparent from the following description of exemplary embodiments with reference to the attached drawing.

DESCRIPTION OF THE EMBODIMENTS

Figure 1:
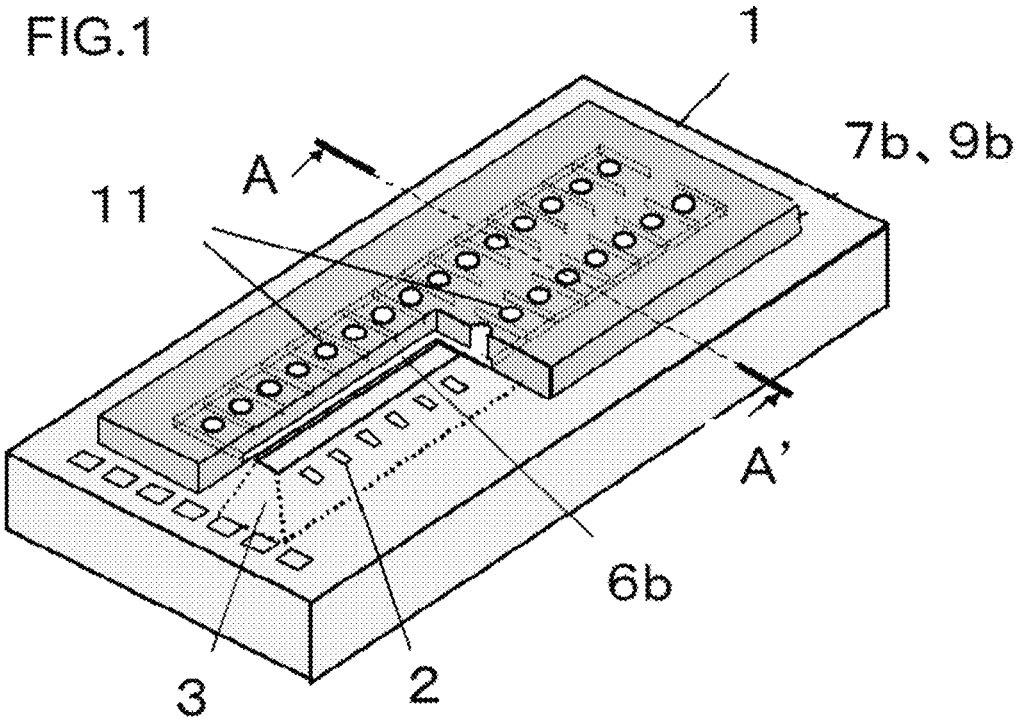
FIG. 1 is a schematic perspective view showing an example of the configuration of a liquid discharge head.

Generally, the coefficients of linear expansion of a substrate and a member such as an ink flow channel forming member formed on the substrate are different. Because of this difference in the coefficient of linear expansion, stress is applied to the substrate due to, for example, changes in the environment in the manufacturing process, the type of liquid used, and the usage environment.

As a result, the stress applied to the substrate may cause the members formed on the substrate to peel off from the substrate, resulting in unstable liquid discharge.

Thus, in the above-described conventional liquid discharge head, a liquid discharge failure may occur due, in particular, to the manufacture or use in a harsh environment or a variety of types of liquid.

The present disclosure provides a liquid discharge head and a method for manufacturing a liquid discharge head that enable satisfactory liquid discharge regardless of manufacture or use in a harsh environment and the type of liquid.

The liquid discharge head of the present disclosure is provided, on a substrate, a flow channel forming member having liquid discharge ports and liquid flow channels, and a support member that is arranged to be in contact with the substrate and at least one surface of the flow channel forming member that is not in contact with the liquid. By forming the support member of a cured product of a photosensitive resin composition including a specific epoxy resin, peeling of members from the substrate can be suppressed.

Hereinafter, embodiments of the present disclosure will be specifically illustrated with reference to the drawings. However, the dimensions, materials, shapes of components described in this form, the relative arrangement thereof, and the like should be changed, as appropriate, depending on the configuration of the members and various conditions to which the disclosure is applied. That is, the scope of the present disclosure is not intended to be limited to the following embodiments.

Further, in the present disclosure, the expression of "from XX to YY" or "XX to YY" indicating a numerical range means a numerical range including a lower limit and an upper limit which are end points, unless otherwise specified.

Also, when a numerical range is described in a stepwise manner, the upper and lower limits of each numerical range can be arbitrarily combined.

Further, in the following description, configurations having the same function may be given the same reference number in the drawings, and the description thereof may be omitted.

As an example of application to a liquid discharge head, an inkjet head will be described by way of example, but the application range of the liquid discharge head is not limited thereto.

The reference symbols in the figures are as follows.

Figure 2:
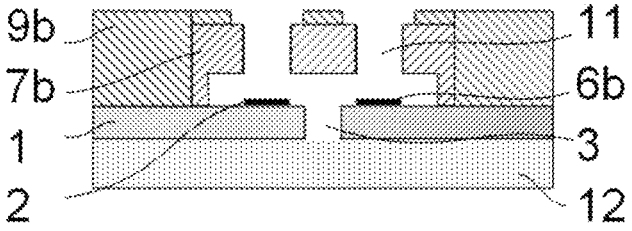
FIG. 2 is an example of a schematic cross-sectional view taken along the A-A' line in FIG. 1.

1: substrate; 2: energy generating element; 3: liquid supply port; 4: positive photosensitive resin composition layer; 5: photomask; 6*a*: pattern that is a mold of a liquid flow channel; 6*b*: liquid flow channel; 7*a*: first photosensitive resin composition layer; 7*b*: flow channel forming member; 8: photomask; 9*a*: second photosensitive resin composition layer; 9*b*: support member; 10: photomask; 11: discharge port; 12: member for ink supply FIG. 1 is a schematic perspective view showing an example of the configuration of a liquid discharge head (inkjet head) according to an embodiment of the present disclosure. Further, FIG. 2 is an example of a schematic cross-sectional view of a liquid discharge head (inkjet head) viewed from a plane perpendicular to the substrate in the A-A' line in FIG. 1.

The inkjet head has a Si substrate 1 in which energy generating elements 2 that generate energy for discharging a liquid (for example, ink) are formed in two rows at a predetermined pitch. A liquid supply port 3 formed by anisotropic etching of Si is opened in the substrate 1 between two rows of energy generating elements 2.

Discharge ports 11 provided at a position facing the respective energy generating elements are formed on the substrate 1 by a flow channel forming member 7*b*.

The flow channel forming member 7*b* also functions as a member for forming individual liquid flow channels 6*b* communicating from the liquid supply port 3 to each discharge port 11. The positions of the discharge ports are not limited to the positions facing the energy generating elements.

The inkjet head is arranged so that the surface on which the discharge ports 11 are formed faces the recording surface of a recording medium. The energy generated by the energy generating elements 2 is used for the ink supplied from a member 12 for ink supply and filled in the liquid flow channels through the liquid supply port 3. With this energy, ink droplets are ejected from the discharge ports 11 and caused to adhere to the recording medium to perform recording.

The energy generating element can be, but is not limited to, thermoelectric conversion element (so-called heater) that generates thermal energy and a piezoelectric element that generates mechanical energy.

An example of the method for manufacturing the liquid discharge head of the present disclosure will be described with reference to FIGS. 3A to 3J.

FIGS. 3A to 3J are schematic cross-sectional views showing, step by step, an example of a method for manufacturing a liquid discharge head (inkjet head). Further, FIGS. 3A to 3J show cross-sectional structures seen in a plane perpendicular to the substrate in the completed state as in FIG. 2.

Figure 3A:
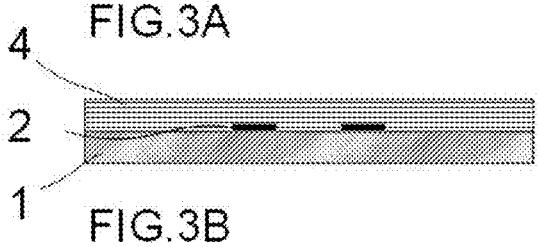
FIGS. 3A to 3J are schematic cross-sectional views showing an example of a process for manufacturing a liquid discharge head.

First, as shown in FIG. 3A, a substrate 1 on which the energy generating element 2 have been provided on the surface is prepared. The shape, material, and the like of the substrate are not particularly limited, provided that the substrate can function as a part of a member constituting the liquid flow channel 6*b*, and can also function as a support for the flow channel forming member 7*b* forming the liquid flow channels 6*b* and the discharge port 11 described hereinbelow.

In the present embodiment, a silicon substrate is used in order to form the liquid supply port 3 penetrating the substrate by anisotropic etching described hereinbelow.

Further, a desired number of thermoelectric conversion elements, piezoelectric elements, and the like are arranged as the energy generating elements 2 on the substrate 1. By such energy generating elements 2, energy for discharging ink droplets is given to a liquid (for example, ink), and recording is performed.

When a thermoelectric element is used as the energy generating element 2, this element heats nearby ink to cause a state change in the ink and generate discharge energy.

Further, when a piezoelectric element is used, discharge energy is generated by mechanical vibrations of the element. A control signal input electrode (not shown) for operating the energy generating element is connected to the element.

In addition, various types of functional layers such as a protective layer (not shown) for improving the durability of the energy generating elements 2 and an adhesion improving layer (not shown) for improving the adhesion between the flow channel forming member and the substrate may be provided.

For example, a positive photosensitive resin composition layer 4 including a positive photosensitive resin is formed on a substrate including the energy generating elements 2. Further, a general-purpose solvent coating method such as spin coating or slit coating can be applied to the formation of the positive photosensitive resin composition layer 4.

Examples of the positive photosensitive resin include poly(methyl isopropenyl ketone) resin, poly(methyl methacrylate) resin, and other vinylketone-based resins that are capable of Deep UV patterning.

Figure 3B:
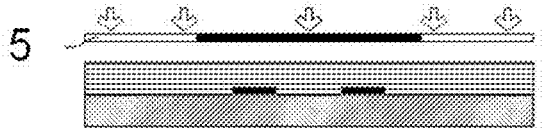
Figure 3C:
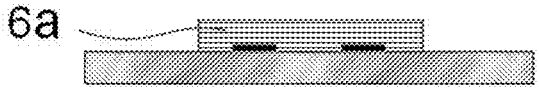

Next, as shown in FIGS. 3B and 3C, the positive photosensitive resin composition layer 4 is patterned by a photolithography step using a photomask 5 to form a pattern 6*a* as a mold of a liquid flow channel.

Figure 3D:
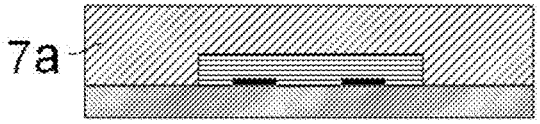

Next, as shown in FIG. 3D, a first photosensitive resin composition layer 7*a* including a photosensitive resin and constituting the flow channel forming member is formed by a method such as a spin coating method, a roll coating method, and a slit coating method on the substrate 1 where the pattern 6*a* as a mold of the liquid flow channels has been formed.

The flow channel forming member is arranged on the substrate and has discharge ports for discharging the liquid and liquid flow channels communicating with the liquid supply port and the discharge ports. The flow channel forming member includes a cured product of the first photosensitive resin composition. Further, it is preferable that the first photosensitive resin composition include a photosensitive resin, and the photosensitive resin in the first photosensitive resin composition preferably includes an epoxy resin that is solid at room temperature.

Further, in the above-described embodiment, the photosensitive resin may be a negative photosensitive resin. The photosensitive resin may be selected from the viewpoints of high mechanical strength, adhesion to the substrate, and ink resistance of a member constituent material after curing, and at the same time, resolution for patterning the fine shapes of the discharge ports. Examples of the material satisfying these characteristics include cationically polymerizable epoxy resins.

As the cationically polymerizable epoxy resin, it is preferable to use a negative photocationically polymerizable epoxy resin. For example, a reaction product of bisphenol A and epichlorohydrin having a molecular weight of about at least 900, and a reaction product of bromobisphenol A and epichlorohydrin can be mentioned.

Further, a reaction product of phenol novolac or cresol novolac and epichlorohydrin may be used. However, these compounds are not limiting.

The epoxy equivalent (unit: g/eq) of the epoxy resin is preferably not more than 2000, and more preferably not more than 1000. When the epoxy equivalent is not more than 2000, a sufficient crosslinking density is obtained during the curing reaction, and the adhesion and ink resistance are excellent. The lower limit of the epoxy equivalent is not particularly limited, but is preferably at least 30, and more preferably at least 50.

The photosensitive resin in the first photosensitive resin composition may include the below-described epoxy resin A as the epoxy resin to the extent that the effects of the present disclosure are not impaired.

When the photosensitive resin in the first photosensitive resin composition includes the epoxy resin A, the amount of the epoxy resin A in the first photosensitive resin composition is preferably less than the amount of the epoxy resin A in the second photosensitive resin composition. Further, it is more preferable that the photosensitive resin in the first photosensitive resin composition does not include the epoxy resin A.

The first photosensitive resin composition may include a polymerization initiator.

For example, a photocationic polymerization initiator that generates an acid under light irradiation can be used as the polymerization initiator for curing a cationically polymerizable epoxy resin.

The polymerization initiator is not particularly limited, and for example, an aromatic sulfonium salt and an aromatic iodonium salt can be used. The aromatic sulfonium salt can be exemplified by TPS-102, 103, 105, MDS-103, 105, 205, 305, DTS-102, 103 commercially available from Midori Chemical Co., Ltd. In addition, SP-170, 172, and the like commercially available from ADEKA Corporation can be mentioned. As the aromatic iodonium salt, DPI-105, MPI-103, 105, BBI-102, 102, 103, 105, and the like commercially available from Midori Chemical Co., Ltd. can be preferably used.

The polymerization initiator can be used in any amount that ensures the target sensitivity, but an amount of 0.5 parts by mass to 5 parts by mass with respect to 100 parts by mass of the epoxy resin is preferable. In addition, if necessary, SP-100, which is commercially available from ADEKA Corporation, may be further included as a wavelength sensitizer.

Further, the above composition can include, as appropriate, an additive and the like if necessary.

For example, a flexibility imparting agent for the purpose of lowering the elastic modulus of the epoxy resin, a silane coupling agent for obtaining further adhesion to the substrate, and the like can be mentioned.

Figure 3E:
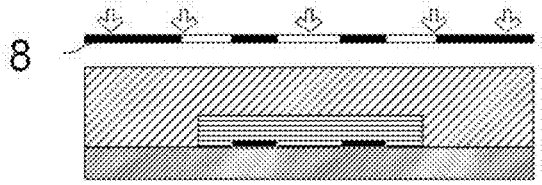
Figure 3F:
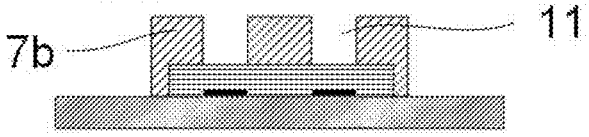

Next, as shown in FIG. 3E, pattern exposure is performed through a photomask 8 and development processing is performed to form the flow channel forming member 7*b* and the discharge ports 11 as shown in FIG. 3F.

Figure 3G:
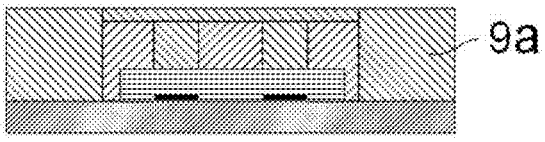

A support member is formed as shown in FIG. 3G and subsequent drawings. The support member is provided on the substrate and arranged so as to be in contact with at least one surface of the flow channel forming member that does not come into contact with the liquid, and includes a cured product of the second photosensitive resin composition.

In FIG. 3G, the second photosensitive resin composition layer 9*a* that forms the support member and includes the epoxy resin A is formed. The forming method is the same as that of the first photosensitive resin composition layer 7*a*.

The second photosensitive resin composition includes the epoxy resin A.

The epoxy resin A has an epoxy group at the end of the molecular chain and has a structure represented by the following formula (a1) or (a2) in the main chain structure. The epoxy group may be the end of the main chain structure or the end of the branched chain structure. Further, it is preferable that one molecule has at least two epoxy groups.

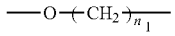

(a1)

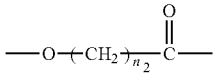

(a2)

In the (a1), $n_1$ represents an integer of at least 2.

The $n_1$ is preferably an integer of from 2 to 50, and more preferably an integer of from 3 to 30. The alkylene group in (a1) may be a straight chain or may have a branched chain. The alkylene group is preferably a propylene group having a branched chain.

In the (a2), $n_z$ represents an integer of at least 2.

The $n_2$ is preferably an integer of from 2 to 50, more preferably an integer of from 3 to 30 or less, and further preferably an integer of from 4 to 10. The alkylene group in (a2) may be a straight chain or may have a branched chain. The $n_2$ is preferably 5.

As such an epoxy resin A, commercially available Epolide GT-401 (Daicel Corporation), Adeka Resin EP-4000 (ADEKA Corporation), or the like may be used.

As described above, the photosensitive resin in the first photosensitive resin composition is a constituent material of the member forming the liquid flow channel and the discharge ports. Therefore, high mechanical strength, adhesion to a base, ink resistance as a member constituent material after curing, and at the same time, resolution for patterning the fine shapes of the discharge ports are required.

By contrast, the photosensitive resin in the second photosensitive resin composition is a constituent material of the support member which occupies most of the substrate other than the flow channel forming member after curing. Therefore, unlike the photosensitive resin in the first photosensitive resin composition, high flexibility and high adhesion to the substrate or a base are needed more that high ink resistance or high resolution.

For this reason, the photosensitive resin in the second photosensitive resin composition includes the epoxy resin A having an epoxy group at the end of the molecular chain and having a structure represented by the formula (a1) or (a2) in the main chain structure. Further, in the case of the above example, the photosensitive resin in the second photosensitive resin composition may be a negative type photosensitive resin, and further may be a negative type cationically polymerizable epoxy resin.

In addition, the photosensitive resin in the second photosensitive resin composition may include the photosensitive resin used in the first photosensitive resin composition and other photosensitive resins to the extent that the effects of the present disclosure are not impaired.

The amount of the epoxy resin A in the second photosensitive resin composition is preferably at least 30% by mass, and more preferably at least 50% by mass, based on the photosensitive resin in the second photosensitive resin composition. The amount of the epoxy resin A is preferably not more than 100% by mass.

The epoxy resin A preferably includes a resin represented by the following formula (1), and more preferably is a resin represented by the following formula (1).

Further, the epoxy resin A preferably includes a resin represented by the following formula (2), and more preferably is a resin represented by the following formula (2).

(1)

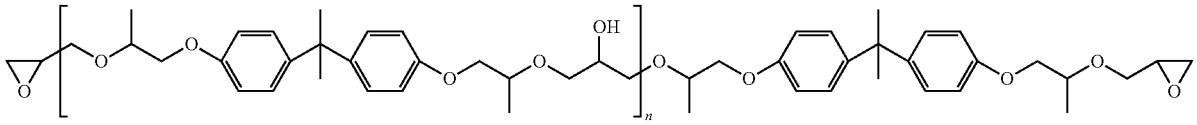

In the formula (1), n represents an integer of at least 1. Then is preferably from 2 to 10.

(2)

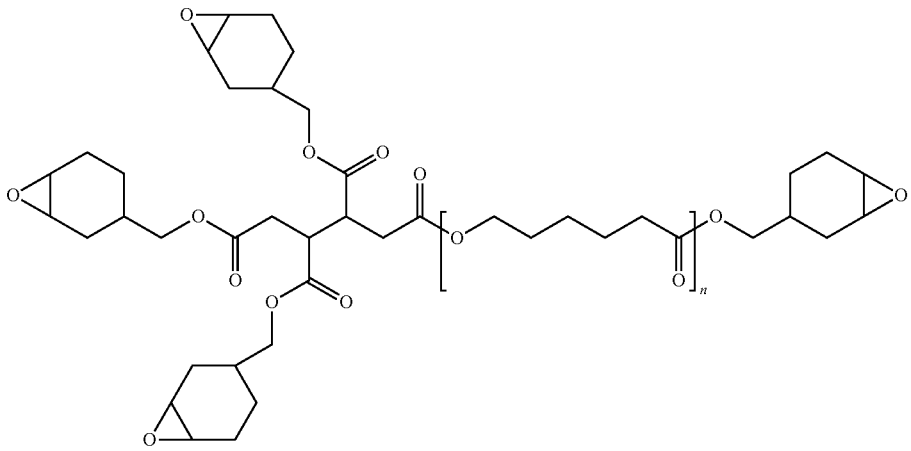

In the formula (2), n represents an integer of at least 1. The n is preferably from 2 to 10.

The epoxy resin A is preferably a liquid resin having stickiness at room temperature or having high stickiness.

Since the photosensitive resin in the second photosensitive resin composition includes the epoxy resin A, the cured product of the second photosensitive resin composition exhibits excellent flexibility, and peeling thereof caused by the stress applied to the substrate can be greatly suppressed. However, in general, the resolution and surface flatness of the cured product tend to be inferior to those of a resin that is solid at room temperature.

Further, the epoxy equivalent (unit: g/eq) of the epoxy resin A is preferably not more than 2000, and more preferably not more than 1000, as for the photosensitive resin in the first photosensitive resin composition described above. Meanwhile, from the viewpoint of obtaining higher flexibility as a member constituent material, the epoxy equivalent is preferably at least 200, and more preferably at least 250.

Further, the second photosensitive resin composition may include a polymerization initiator.

For example, a photocationic polymerization initiator for curing the cationically polymerizable epoxy resin A and an additive are the same as those described for the first photosensitive resin composition described above.

From the viewpoint of further suppressing peeling from the substrate, the volume of the cured product of the first photosensitive resin composition on the substrate is preferably not more than ½ and more preferably not more than ⅓ of the volume of the cured product of the second photosensitive resin composition.

Figure 3H:
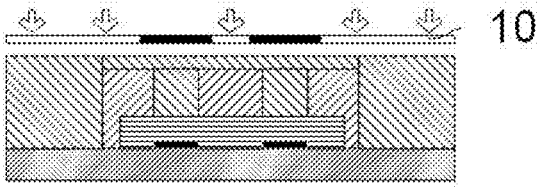
Figure 3I:
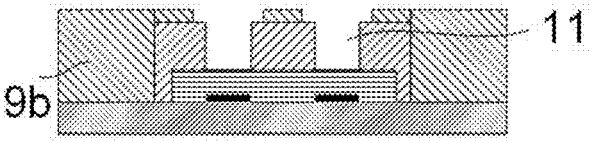

Next, as shown in FIG. 3H, pattern exposure is performed through the photomask 10 and development processing is performed. As a result, as shown in FIG. 3I, a support member 9*b* is formed that is arranged outside the portion on the substrate where the flow channel forming member 7*b* is arranged, and so as to be in contact with the side surface of the flow channel forming member 7*b* that does not come into contact with the liquid, and with the upper surface of the flow channel forming member 7*b* outside the liquid discharge portion of the discharge port 11.

Figure 3J:
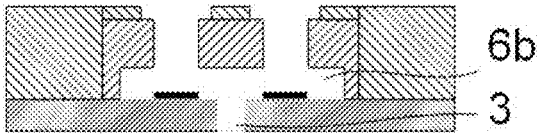

Next, as shown in FIG. 3J, the liquid supply port 3 penetrating the substrate 1 is formed, and the pattern 6*a* that serves as a mold of the liquid flow channel is removed to form the liquid flow channel 6*b*.

Further, heat treatment is performed, as necessary, members for liquid supply are joined, and electrical joining (not shown) for driving the energy generating elements 2 is performed to complete the liquid discharge head.

Further, if necessary, a water-repellent layer may be provided on the flow channel forming member 7*b* and/or on the support member 9*b* in order to impart water repellency. Of course, a difference in water repellency may be provided between the flow channel forming member 7*b* and the support member 9*b*.

Figure 4:
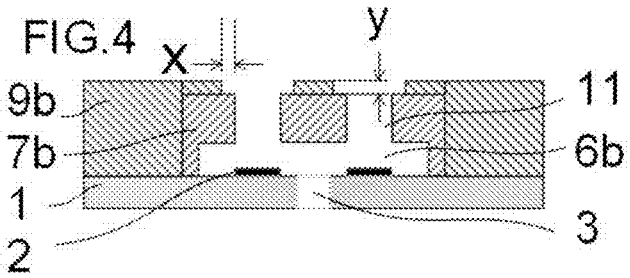
FIG. 4 is an example of a schematic cross-sectional view of the vicinity of a discharge port on the A-A' line in FIG. 1.

Here, FIG. 4 shows an example of a schematic cross-sectional view of the vicinity of the discharge port on the A-A' line of FIG. 1A. In the present embodiment, the support member 9*b* is arranged on the upper surface of the flow channel forming member 7*b* on the discharge port side, and the distance x from the end portion of the support member 9*b* on the discharge port side to the outer circumference of the discharge port is preferably from 1 μm to 10 μm from the viewpoint of the end shape of the discharge port 11. The distance x may be 0 μm.

Further, in the above-described embodiment, the support member 9*b* is arranged on the upper surface of the flow channel forming member 7*b* on the discharge port side, and the thickness y of the support member 9*b* arranged on the upper surface on the discharge port side in the direction perpendicular to the substrate is preferably not more than 10 μm. This is done so because, for example, when a wiping mechanism is provided to remove the liquid near the discharge port 11, it is possible to cope with the intrusion of the wiping blade. The thickness y may be 0 μm. Further, these values are not limiting due to the relationship with the abovementioned distance x and the mechanism of the wiping blade.

By using the method for manufacturing an inkjet head described above, it is possible to manufacture an inkjet head in which each member formed on the substrate is prevented from peeling off from the substrate. In addition, it is possible to manufacture a liquid discharge head that enables satisfactory ink discharge regardless of manufacture or use in a harsh environment and the type of ink.

EXAMPLES

Hereinafter, the present disclosure will be described in detail with reference to Examples and Comparative Examples, but the present disclosure is not limited to the configurations embodied in these Examples. Further, "parts" used in Examples and Comparative Examples means "parts by mass" unless otherwise specified.

Example 1

Evaluation of Adhesion

A poly(methyl isopropenyl ketone) resin solution was applied to the silicon substrate 1 by spin coating, and then baked at 1120° C. for 6 min to prepare a positive photosensitive resin composition layer 4 (FIG. 3A). The film thickness of this layer was 10 μm. Then, exposure was performed with a Deep UV exposure apparatus UX-3300 manufactured by Ushio, Inc. (FIG. 3B). After subsequent paddle development with methyl isobutyl ketone for 60 sec, shower rinsing treatment with isopropyl alcohol for 30 seconds was carried out to form a pattern 6*a* that is a mold of a liquid flow channel (FIG. 3C).

Next, the first negative photosensitive resin composition shown in Table 1 was applied by spin coating and then baked at 90° C. for 5 min to form the first negative photosensitive resin composition layer 7*a* (FIG. 3D). The film thickness of the first negative photosensitive resin composition layer 7*a* was 20 μm on the substrate and 10 μm on the pattern 6*a* that is the mold of the liquid flow channel.

TABLE 1

| First negative photosensitive resin composition | | | | | |
|---|---|---|---|---|---|
| Epoxy resin | | Photocationic polymerization initiator | | Solvent | |
| Name | Compounded amount (parts by mass) | Name | Compounded amount (parts by mass) | Name | Compounded amount (parts by mass) |
| EHPE3150 Daicel Corporation | 50 | SP-172 ADEKA Corporation | 1 | Xylene | 50 |

EHPE3150 (manufactured by Daicel Corporation) in the table is a 1,2-epoxy-4-(2-oxylanyl)cyclohexane adduct of 2,2-bis(hydroxymethyl)-1-butanol (generic name).

Next, the photomask 8 was used to pattern the first negative photosensitive resin composition layer 7*a* in order to form the discharge ports (FIG. 3E). As an exposure apparatus, an i-line stepper FPA-3000i5+ manufactured by Canon Inc. was used, and pattern exposure was performed at an exposure amount of 5000 J/m$^2$. Then, development with methyl isobutyl ketone and rinsing with xylene were performed, and then heat treatment was carried out at 140° C. for 4 min (FIG. 3F).

Next, the second negative photosensitive resin composition shown in Table 2 was applied by spin coating and then baked at 90° C. for 5 min to form the second negative photosensitive resin composition layer 9*a* (FIG. 3G). The film thickness of the second negative photosensitive resin composition layer 9*a* was 22 μm on the substrate and 2 μm on the first negative photosensitive resin composition layer 7*a*.

TABLE 2

| Second negative photosensitive resin composition | | | | | |
|---|---|---|---|---|---|
| Epoxy resin | | Photocationic polymerization initiator | | Solvent | |
| Name | Compounded amount (parts by mass) | Name | Compounded amount (parts by mass) | Name | Compounded amount (parts by mass) |
| Resin represented by formula (1) | 50 | SP-172 ADEKA Corporation | 1 | Xylene | 50 |

Adeka Resin EP-4000 (ADEKA Corporation) was used as the "Resin represented by formula (1)" in the table.

Next, a photomask 10 was used to pattern the second negative photosensitive resin composition layer 9*a* (FIG. 3H). As an exposure apparatus, the i-line stepper FPA-3000i5+ manufactured by Canon Inc. was used, and pattern exposure was performed at an exposure amount of 5000 J/m$^2$. Then, after developing with methyl isobutyl ketone and rinsing with xylene, heat treatment was performed at 140° C. for 4 min to form a flow channel forming member 7*b* having discharge ports 11 and support members 9*b* (FIG. 3I).

Next, an etching mask (not shown) was formed on the back surface of the substrate to be processed, and the silicon substrate was anisotropically etched to form the liquid supply port 3. After that, a Deep UV exposure apparatus UX-3300 manufactured by Ushio, Inc. was used to perform full exposure through a negative resist at an exposure amount of 25,000 mJ/cm$^2$ to solubilize the pattern 6*a* that is a mold of the liquid flow channels. Subsequently, the structure was immersed in methyl lactate while applying ultrasonic waves to dissolve and remove the pattern 6*a* that is a mold of the liquid flow channel and form the liquid flow channel 6*b* (FIG. 3J).

The adhesion of the adhesive measurement sample prepared by the above-described method was evaluated by the following method.

First, an ink of pure water/diethylene glycol/isopropyl alcohol/lithium acetate/black dye Food Black 2 (mass ratio)=79.4/15/3/0.1/2.5 was prepared. A measurement sample was immersed in this ink, and a 10-h cycle was repeated 60 times in a pressure cooker test (PCT test) (conditions: 121° C., 2 atm).

After that, the adhesion was evaluated by the following method as to whether the flow channel forming member 7*b* and/or the support member 9*b* was peeled off from the substrate. The results are shown in Table 5.

Evaluation

Visual observation with a metallurgical microscope was performed, and samples in which no peeling from the substrate was confirmed were evaluated as A, and those in which peeling from the substrate was confirmed were evaluated as B.

Example 2

An adhesion measurement sample was prepared in the same manner as in Example 1 except that the second negative photosensitive resin composition shown in Table 3 hereinbelow was used, and the adhesion was evaluated using the same method as in Example 1. The results are shown in Table 5.

TABLE 3

| Second negative photosensitive resin composition | | | | | |
|---|---|---|---|---|---|
| Epoxy resin | | Photocationic polymerization initiator | | Solvent | |
| Name | Compounded amount (parts by mass) | Name | Compounded amount (parts by mass) | Name | Compounded amount (parts by mass) |
| Resin represented by formula (2) | 50 | SP-172 ADEKA Corporation | 1 | Xylene | 50 |

In the table, Epolide GT-401 (Daicel Corporation) was used as the "Resin represented by formula (2)".

Comparative Example 1

An adhesion measurement sample was prepared in the same manner as in Example 1 except that the second negative photosensitive resin composition shown in Table 4 hereinbelow was used, and the adhesion was evaluated using the same method as in Example 1. The results are shown in Table 5.

TABLE 4

| Second negative photosensitive resin composition | | | | | |
|---|---|---|---|---|---|
| Epoxy resin | | Photocationic polymerization initiator | | Solvent | |
| Name | Compounded amount (parts by mass) | Name | Compounded amount (parts by mass) | Name | Compounded amount (parts by mass) |
| EHPE3150 Daicel Corporation | 50 | SP-172 ADEKA Corporation | 1 | Xylene | 50 |

TABLE 5

| | First negative photosensitive resin composition Epoxy resin | Second negative photosensitive resin composition Epoxy resin | PCT test evaluation |
|---|---|---|---|
| Example 1 | EHPE3150 Daicel Corporation | Resin represented by formula (1) | A |
| Example 2 | EHPE3150 Daicel Corporation | Resin represented by formula (2) | A |
| Comparative Example 1 | EHPE3150 Daicel Corporation | EHPE3150 Daicel Corporation | B |

The results shown in Table 5 will be described below.

As shown in Examples 1 and 2, when the epoxy resin A was used as the epoxy resin contained in the second negative photosensitive resin composition, the cured product of the composition had high flexibility. As a result, the deformation of the substrate that occurred in the PCT test did not cause the composition to peel off from the substrate.

The flow channel forming member including the cured product of the first negative photosensitive resin composition could occupy a small area on the substrate, and no peeling thereof from the substrate could be confirmed even though the epoxy resin A was not used.

By contrast, as shown in Comparative Example 1, when the epoxy resin A was not used as the epoxy resin contained in the second negative photosensitive resin composition, peeling from the substrate was confirmed, although it was slight.

Example 3

Inkjet Head Evaluation

The inkjet head shown in FIG. 2 was produced according to the method described with reference to FIGS. 3A to 3J hereinabove.

First, a silicon substrate 1 was prepared in which a thermoelectric conversion element (heater made of material $HfB_2$) as an energy generating element 2 and a laminated film of silicon nitride (SiN) and Ta (not shown) were provided in a region for forming a flow channel forming member.

A poly(methyl isopropenyl ketone) resin solution was applied to the silicon substrate 1 by spin coating, and then baked at 1120° C. for 6 min to prepare a positive photosensitive resin composition layer 4 (FIG. 3A). The film thickness of this layer was 10 μm. Then, exposure was performed with a Deep UV exposure apparatus UX-3300 manufactured by Ushio, Inc. (FIG. 3B). After subsequent paddle development with methyl isobutyl ketone for 60 sec, shower rinsing treatment with isopropyl alcohol for 30 seconds was carried out to form a pattern 6*a* as a mold of the liquid flow channels (FIG. 3C).

Next, the first negative photosensitive resin composition shown in Table 1 was applied by spin coating and then baked at 90° C. for 5 min to form the first negative photosensitive resin composition layer 7*a* (FIG. 3D). The film thickness of the first negative photosensitive resin composition layer 7*a* was 20 μm on the substrate and 10 μm on the pattern 6*a* as a mold of the liquid flow channels.

Next, the photomask 8 was used to pattern the first negative photosensitive resin composition layer 7*a* in order to form the discharge ports (FIG. 3E). As an exposure apparatus, an i-line stepper FPA-3000i5+ manufactured by Canon Inc. was used, and pattern exposure was performed at an exposure amount of 5000 J/m$^2$. Then, development with methyl isobutyl ketone and rinsing with xylene were performed, and then heat treatment was carried out at 140° C. for 4 min (FIG. 3F).

Next, the second negative photosensitive resin composition shown in Table 2 was applied by spin coating and then baked at 90° C. for 5 min to form the second negative photosensitive resin composition layer 9*a* (FIG. 3G). The film thickness of the second negative photosensitive resin composition layer 9*a* was 22 μm on the substrate and 2 μm on the first negative photosensitive resin composition layer 7*a*.

Next, a photomask 10 was used to pattern the second negative photosensitive resin composition layer 9*a* (FIG. 3H). As an exposure apparatus, the i-line stepper FPA-3000i5+ manufactured by Canon Inc. was used, and pattern exposure was performed at an exposure amount of 5000 J/m$^2$. Then, after developing with methyl isobutyl ketone and rinsing with xylene, heat treatment was performed at 140° C. for 4 min to form the flow channel forming member 7*b* having discharge ports 11 and support members 9*b* (FIG. 3I).

Next, an etching mask (not shown) was formed on the back surface of the substrate to be processed, and the silicon substrate was anisotropically etched to form the liquid supply port 3. After that, a Deep UV exposure apparatus UX-3300 manufactured by Ushio, Inc. was used to perform full exposure through a negative resist at an exposure amount of 25,000 mJ/cm$^2$ to solubilize the pattern 6*a* that is a mold of the liquid flow channel. Subsequently, the structure was immersed in methyl lactate while applying ultrasonic waves to dissolve and remove the pattern 6*a* that is a mold of the liquid flow channel and form the liquid flow channel 6*b* (FIG. 3J).

Further, in order to completely cure the flow channel forming member 7*b* and the support member 9*b*, heat treatment was performed at 200° C. for 1 h, members for ink supply (not shown) were joined, and electric joining (not shown) for driving the energy generating elements 2 was performed. As a result, the inkjet head was completed.

The obtained inkjet head was set in the printer. A discharge durability test was conducted using an ink of pure water/diethylene glycol/isopropyl alcohol/lithium acetate/black dye Food Black 2 (mass ratio)=79.4/15/3/0.1/2.5. The results are shown in Table 6.

In the ink discharge durability test, 15,000 prints were printed continuously, and the ink landing accuracy before and after the durability and the peeling of the flow channel forming member and the support member from the substrate of the inkjet head after the durability were evaluated. The evaluation was made according to the following criteria. All evaluations are by visual measurement and observation with a metallurgical microscope.

Evaluation of Ink Landing Accuracy

A: Ink landing deviation between before and after durability is within 5 μm.

B: Ink landing deviation between before and after durability is more than 5 μm and within 10 μm.

C: Ink landing deviation between before and after durability is over 10 μm.

Evaluation of Peeling

A: No peeling of the flow channel forming member and support member from the substrate after durability.

B: There is peeling of the flow channel forming member and the support member from the substrate after durability.

Example 4

An inkjet head was produced in the same manner as in Example 3 except that the second negative photosensitive resin composition shown in Table 3 above was used, and the evaluation was carried out using the same method as in Example 3. The results are shown in Table 6.

TABLE 6

| | First negative photosensitive resin composition Epoxy resin | Second negative photosensitive resin composition Epoxy resin | Ink landing accuracy | Peeling |
|---|---|---|---|---|
| Example 1 | EHPE3150 Daicel Corporation | Resin represented by Formula (1) | A | A |
| Example 2 | EHPE3150 Daicel Corporation | Resin represented by Formula (2) | A | A |

As shown in Table 6, the inkjet heads manufactured according to Examples 3 and 4 were confirmed to have good ink landing accuracy and high reliability without peeling from the substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-010956, filed Jan. 27, 2020, which is hereby incorporated by reference herein in its entirety.

What is claimed is:

1. A liquid discharge head comprising:

a substrate having a liquid supply port;

a flow channel forming member that is provided on the substrate and has discharge ports for discharging a liquid and a liquid flow channel that makes the liquid supply port and the discharge ports communicate with each other; and a support member that is provided on the substrate and arranged to be in contact with at least one surface of the flow channel forming member, with the one surface not being in contact with the liquid, wherein:

the flow channel forming member includes a cured product of a first photosensitive resin composition, the support member includes a cured product of a second photosensitive resin composition, the first photosensitive resin composition includes a photosensitive resin, and the second photosensitive resin composition includes an epoxy resin A having an epoxy group at an end of a molecular chain and having a structure represented by formula (a1) or (a2) in a main chain structure:

(a1)

$$-O-(CH_2)_{n_1}-$$

(a2)

$$-O-(CH_2)_{n_2}-\overset{\overset{O}{\|}}{C}-,$$

where, in (a1), $n_1$ represents an integer of at least 2, and in (a2), $n_2$ represents an integer of at least 2.

2. The liquid discharge head according to claim 1, wherein in a case where the photosensitive resin in the first photosensitive resin composition includes the epoxy resin A, an amount of the epoxy resin A in the first photosensitive resin composition is less than an amount of the epoxy resin A in the second photosensitive resin composition.

3. The liquid discharge head according to claim 1, wherein $n_1$ represents an integer of from 2 to 50 in the (a1).

4. The liquid discharge head according to claim 1, wherein $n_2$ represents an integer of from 2 to 50 in the (a2).

5. The liquid discharge head according to claim 3, wherein the epoxy resin A includes a resin represented by a formula (1):

(1)

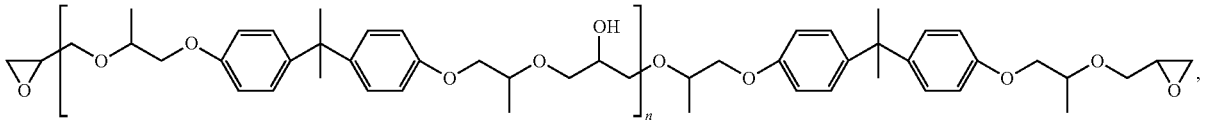

where, in the formula (1), n represents an integer of at least 1.

6. The liquid discharge head according to claim 4, wherein the epoxy resin A includes a resin represented by a formula (2):

(2)

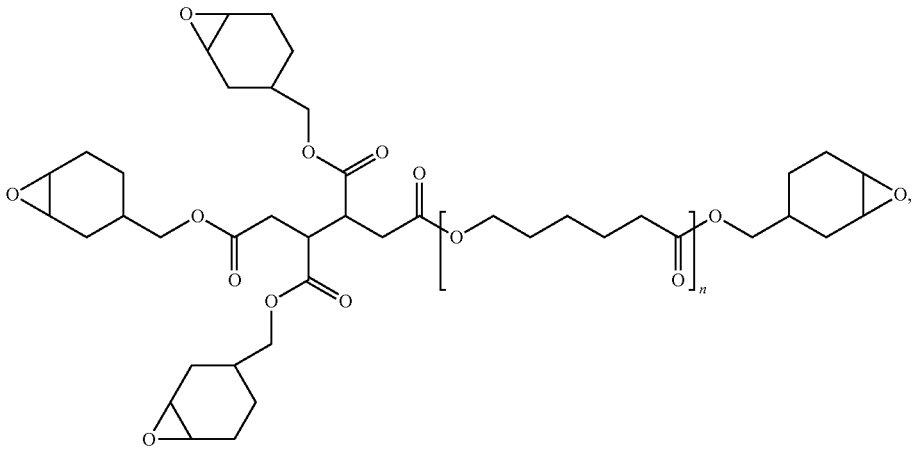

where, in the formula (2), n represents an integer of at least 1.

7. The liquid discharge head according to claim 1, wherein the photosensitive resin in the first photosensitive resin composition includes an epoxy resin that is solid at room temperature.

8. The liquid discharge head according to claim 1, wherein the photosensitive resin in the first photosensitive resin composition does not contain the epoxy resin A.

9. The liquid discharge head according to claim 1, wherein a volume of the cured product of the first photosensitive resin composition on the substrate is not more than ½ of a volume of the cured product of the second photosensitive resin composition.

10. The liquid discharge head according to claim 1, wherein a volume of the cured product of the first photosensitive resin composition on the substrate is not more than ⅓ of a volume of the cured product of the second photosensitive resin composition.

11. The liquid discharge head according to claim 1, wherein the support member is arranged on an upper surface of the flow channel forming member on a discharge port side thereof, and a distance x from an end portion of the support member on the discharge port side to an outer periphery of the discharge port is from 1 μm to 10 μm.

12. The liquid discharge head according to claim 1, wherein the support member is arranged on an upper surface of the flow channel forming member on a discharge port side thereof, and a thickness y of the support member arranged on the upper surface on the discharge port side in a direction perpendicular to the substrate is not more than 10 μm.

13. A method for manufacturing a liquid discharge head including:

a substrate having a liquid supply port;

a flow channel forming member that is provided on the substrate and has discharge ports for discharging a liquid and a liquid flow channel that makes the liquid supply port and the discharge ports communicate with each other; and a support member that is provided on the substrate and arranged to be in contact with at least one surface of the flow channel forming member, with the one surface not being in contact with the liquid, the method comprising:

patterning a first photosensitive resin composition on the substrate to form the flow channel forming member; and patterning a second photosensitive resin composition to form the support member, wherein:

the first photosensitive resin composition includes a photosensitive resin, and the second photosensitive resin composition includes an epoxy resin A having an epoxy group at an end of a molecular chain and having a structure represented by formula (a1) or (a2) in a main chain structure:

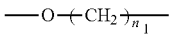

(a1)

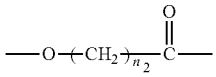

(a2)

where, in (a1), $n_1$ represents an integer of at least 2, and in (a2), $n_2$ represents an integer of at least 2.

* * * * *